US007615520B2

(12) United States Patent
Esche, Jr.

(10) Patent No.: US 7,615,520 B2
(45) **Date of Patent: *Nov. 10, 2009**

(54) ADDITIVES AND LUBRICANT FORMULATIONS FOR IMPROVED ANTIOXIDANT PROPERTIES

(75) Inventor: Carl K. Esche, Jr., Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 435 days.

This patent is subject to a terminal disclaimer.

(21) Appl. No.: 11/080,007

(22) Filed: Mar. 14, 2005

(65) Prior Publication Data

US 2006/0205615 A1 Sep. 14, 2006

(51) Int. Cl.
*C10M 129/26* (2006.01)
*C10M 125/00* (2006.01)

(52) U.S. Cl. ..... 508/165; 508/179; 123/1 A

(58) Field of Classification Search ..... 508/165, 508/179; 123/1 A

See application file for complete search history.

(56) References Cited

U.S. PATENT DOCUMENTS 2,160,273 A 5/1939 Loane et al.
2,384,577 A 9/1945 Thomas
2,621,195 A 12/1952 Haslam
2,710,872 A 6/1955 Thompson
2,719,125 A 9/1955 Roberts
2,719,126 A 9/1955 Fields et al.
2,786,866 A 3/1957 Hook et al.
2,897,152 A 7/1959 Elliott et al.
2,960,469 A 11/1960 Young
2,995,569 A 8/1961 Hamilton et al.
3,017,361 A * 1/1962 Lawrence et al. ..... 508/539
3,087,932 A 4/1963 Lille, Jr.
3,127,351 A * 3/1964 Brown et al ..... 508/383
3,219,666 A 11/1965 Norman et al.
3,277,002 A 10/1966 Hunt et al.
3,356,702 A 12/1967 Farmer et al.
3,399,139 A 8/1968 Forbes et al.
3,407,222 A 10/1968 Lies
3,445,386 A 5/1969 Otto et al.
3,458,548 A 7/1969 Carlson
3,509,051 A 4/1970 Farmer et al.
3,565,804 A 2/1971 Honnen et al.
3,673,090 A 6/1972 Walbillig et al.
3,697,574 A 10/1972 Piasek et al.
3,699,118 A 10/1972 Donham
3,703,504 A 11/1972 Horodysky
3,703,505 A 11/1972 Horodysky et al.
3,736,357 A 5/1973 Piasek et al.
3,758,493 A 9/1973 Maddox, Jr.
3,762,890 A 10/1973 Collins
3,794,081 A 2/1974 Fiser et al.
3,796,661 A 3/1974 Suratwala et al.
3,821,236 A 6/1974 Ripple
3,867,359 A 2/1975 Beadle
3,873,454 A 3/1975 Horodysky et al.
3,904,537 A 9/1975 Ripple
3,969,281 A 7/1976 Sharp
4,029,587 A 6/1977 Koch
4,097,387 A 6/1978 Caspari
4,098,705 A 7/1978 Sakurai et al.
4,107,059 A 8/1978 King et al.
4,122,033 A 10/1978 Black
4,136,043 A 1/1979 Davis
4,137,183 A 1/1979 Caspari
4,164,473 A 8/1979 Coupland et al.
4,171,268 A 10/1979 Collins
4,176,073 A 11/1979 Ryer et al.
4,176,074 A 11/1979 Coupland et al.
4,178,258 A 12/1979 Papay et al.
4,188,299 A 2/1980 Caspari
4,192,757 A 3/1980 Brewster
4,193,882 A 3/1980 Gemmill, Jr.
4,210,683 A 7/1980 Praxl et al.
4,234,435 A 11/1980 Meinhardt et al.
4,248,720 A 2/1981 Coupland et al.
4,259,195 A 3/1981 King et al.
4,261,843 A 4/1981 King et al.
4,263,152 A 4/1981 King et al.
4,265,773 A 5/1981 de Vries et al.
4,266,945 A 5/1981 Karn
4,272,387 A 6/1981 King et al.
4,283,295 A 8/1981 de Vries et al.
4,285,822 A 8/1981 de Vries et al.
4,289,635 A 9/1981 Schroeck
4,362,633 A 12/1982 Spence et al.
4,363,322 A 12/1982 Andersson
4,369,119 A 1/1983 de Vries et al.
4,383,931 A 5/1983 Ryu et al.

(Continued)

FOREIGN PATENT DOCUMENTS

EP 330522 12/1994

(Continued)

OTHER PUBLICATIONS

Pirro, D.M., and Wessol, A.A., Lubrication Fundamentals, CRC Press, 2001, p. 282-283.*

*Primary Examiner*—Glenn Caldarola
*Assistant Examiner*—Jim Goloboy
(74) *Attorney, Agent, or Firm*—Luedeka, Neely & Graham, PC

(57) ABSTRACT

A method and compositions for lubricating surfaces with lubricating oils exhibiting increased antioxidant properties. The lubricated surface includes a lubricant composition containing a base oil of lubricating viscosity and an amount of at least one hydrocarbon soluble metal compound effective to provide a reduction in oxidation of the lubricant composition greater than a reduction in oxidation of the lubricant composition devoid of the hydrocarbon soluble metal compound. The metal of the metal compound is selected from the group consisting of titanium, zirconium, and manganese.

23 Claims, No Drawings

U.S. PATENT DOCUMENTS 4,395,343 A 7/1983 De Vries et al.
4,402,840 A 9/1983 de Vries et al.
4,466,901 A 8/1984 Hunt et al.
4,479,883 A 10/1984 Shaub et al.
4,517,114 A 5/1985 Oppenlaender et al.
4,555,352 A * 11/1985 Garner et al. ..... 508/213
4,636,322 A 1/1987 Nalesnik
4,654,156 A 3/1987 Horodysky et al.
4,692,256 A 9/1987 Umemura et al.
4,702,850 A 10/1987 Gutierrez et al.
4,713,184 A 12/1987 Zaid
4,758,362 A 7/1988 Butke
4,765,918 A 8/1988 Love et al.
4,824,611 A 4/1989 Cells
4,837,190 A 6/1989 Summers, III et al.
4,838,931 A 6/1989 Liebl et al.
4,849,123 A 7/1989 Tipton et al.
4,857,214 A 8/1989 Papay et al.
4,867,890 A 9/1989 Colclough et al.
4,876,375 A 10/1989 Lam
4,885,365 A 12/1989 Lam
4,889,647 A 12/1989 Rowan et al.
4,904,401 A 2/1990 Ripple et al.
4,927,552 A 5/1990 Lam
4,938,880 A 7/1990 Waddoups et al.
4,957,643 A 9/1990 Lam
4,957,649 A 9/1990 Ripple et al.
4,962,256 A 10/1990 Le et al.
4,966,719 A 10/1990 Coyle et al.
4,978,464 A 12/1990 Coyle et al.
4,990,271 A 2/1991 Francis
4,995,996 A 2/1991 Coyle et al.
5,000,863 A 3/1991 Watanabe
5,027,901 A 7/1991 French et al.
5,055,211 A 10/1991 Habeeb et al.
5,110,488 A * 5/1992 Tipton et al. ..... 508/192
5,137,647 A 8/1992 Karol
5,204,012 A 4/1993 Schaffhausen
5,242,613 A 9/1993 Ozbalik et al.
5,260,466 A 11/1993 McGibbon
5,286,394 A 2/1994 Moore
5,287,731 A 2/1994 Florkowski et al.
5,292,480 A 3/1994 Fischer et al.
5,322,640 A 6/1994 Byrne et al.
5,328,620 A * 7/1994 Ripple ..... 508/372
5,387,351 A * 2/1995 Kumar et al. ..... 508/165
5,401,661 A 3/1995 Florkowski et al.
5,412,130 A 5/1995 Karol
5,484,542 A 1/1996 Cahoon et al.
5,486,300 A 1/1996 Salomon et al.
5,490,945 A 2/1996 Smith et al.
5,562,864 A 10/1996 Salomon et al.
5,627,259 A 5/1997 Thaler et al.
5,633,326 A 5/1997 Patil et al.
5,643,859 A 7/1997 Gutierrez et al.
5,652,201 A * 7/1997 Papay et al. ..... 508/228
5,686,397 A 11/1997 Baranski et al.
5,693,598 A 12/1997 Abraham et al.
5,747,430 A 5/1998 Matsushita et al.
5,753,596 A 5/1998 Martin et al.
5,759,485 A 6/1998 Fischer et al.
5,773,391 A 6/1998 Lawate et al.
5,789,357 A 8/1998 Baranski et al.
5,792,729 A 8/1998 Harrison et al.
5,851,965 A 12/1998 Harrison et al.
5,853,434 A 12/1998 Harrison et al.
5,902,776 A 5/1999 Dohner et al.
5,936,040 A 8/1999 Costello et al.
5,939,362 A 8/1999 Johnson et al.
6,034,040 A 3/2000 Ozbalik et al.
6,074,444 A 6/2000 Bingley
6,096,691 A 8/2000 Conary et al.
6,103,674 A 8/2000 Nalesnik et al.
6,114,288 A 9/2000 Fujitsu et al.
6,117,826 A 9/2000 Baranski et al.
6,172,012 B1 * 1/2001 Kumar et al. ..... 508/165
6,232,276 B1 5/2001 Stiefel et al.
6,268,316 B1 * 7/2001 Tanaka et al. ..... 508/291
6,300,291 B1 10/2001 Hartley et al.
6,338,819 B1 1/2002 Braga et al.
6,423,470 B1 * 7/2002 Scheibner et al. ..... 430/275.1
6,509,303 B1 1/2003 Gatto
6,528,461 B1 * 3/2003 Mike et al. ..... 508/287
6,528,463 B1 3/2003 Gatto et al.
6,562,765 B1 * 5/2003 Boffa ..... 508/221
6,599,472 B1 7/2003 Hudson
6,599,865 B1 7/2003 Esche, Jr. et al.
6,723,685 B2 4/2004 Hartley et al.
6,797,677 B2 9/2004 Esche, Jr. et al.
6,800,594 B2 10/2004 Miksic et al.
2004/0200996 A1 10/2004 Meyer
2004/0204325 A1 10/2004 Takahashi
2004/0266630 A1 12/2004 George et al.

FOREIGN PATENT DOCUMENTS

EP 0995790 4/2000
GB 885679 12/1961
GB 1560830 2/1980
GB 866054 4/1991
JP 61-111397 5/1986
JP 62236894 10/1987
JP 03-190997 A 8/1991
JP 10-259392 A 9/1998
JP 11-131084 A 5/1999
JP 2002-302691 10/2002
JP 2004149762 5/2004
JP 2004-182829 A 7/2004
SU 1669975 A 8/1991
SU 1669976 A 8/1991
WO WO 87/04454 7/1987
WO WO 8704454 7/1987
WO WO 9811181 3/1998
WO WO 02092734 11/2002

* cited by examiner

ADDITIVES AND LUBRICANT FORMULATIONS FOR IMPROVED ANTIOXIDANT PROPERTIES

TECHNICAL FIELD

The embodiments described herein relate to particular oil soluble metal additives and use of such metal additives in lubricating oil formulations, and in particular to soluble metal additives used to improve anti-oxidation properties of lubricant formulations.

BACKGROUND

Lubricating oils used in passenger cars and heavy duty diesel engines have changed over the years. Today's engines are designed to run hotter and harder than in the past. However, an adverse affect of runner hotter is that oxidation of the oils increases as the operating temperature of the oil increases. Oxidation of the oils may lead to a viscosity increase in the oil and the formation of high temperature deposits caused by agglomerated oxidation by-products baking onto lubricated surfaces. Accordingly, certain phosphorus and sulfur additives have been used to reduce engine oil oxidation.

However, the next generation of passenger car motor oil and heavy duty diesel engine oil categories may require the presence of lower levels of phosphorus and sulfur containing antioxidant additives in the formulations in order to reduce contamination of more stringent pollution control devices. It is well known that sulfur and phosphorus containing additives may poison or otherwise reduce the effectiveness of pollution control devices.

With regard to the above, a need exists for a lubricating additive that provides excellent antioxidant properties and is more compatible with pollution control devices used for automotive and diesel engines. Such additives may contain phosphorus and sulfur or may be substantially devoid of phosphorus and sulfur.

SUMMARY OF THE EMBODIMENTS

In one embodiment herein is presented a lubricated surface containing a lubricant composition including a base oil of lubricating viscosity and an amount of at least one hydrocarbon soluble metal compound effective to provide a reduction in oxidation of the lubricant composition greater than a reduction in oxidation of the lubricant composition devoid of the hydrocarbon soluble metal compound wherein the metal of the metal compound is selected from the group consisting of titanium, zirconium, and manganese.

In another embodiment, there is provided a vehicle having moving parts and containing a lubricant for lubricating the moving parts. The lubricant includes an oil of lubricating viscosity, an organomolybdenum friction modifier, and an amount of at least one hydrocarbon soluble metal compound effective to provide a reduction in oxidation of the lubricant composition greater than a reduction in oxidation of the lubricant composition devoid of the hydrocarbon soluble metal compound. The metal of the metal compound is selected from the group consisting of titanium, zirconium, and manganese and the compound is essentially devoid of sulfur and phosphorus atoms. The lubricant is substantially devoid of phenolic antioxidant compounds.

In yet another embodiment there is provided a fully formulated lubricant composition including a base oil component of lubricating viscosity, an organomolybdenum friction modifier, and an amount of hydrocarbon soluble metal-containing agent effective to provide a reduction in oxidation of the lubricant composition greater than a reduction in oxidation of the lubricant composition devoid of the hydrocarbon soluble metal-containing agent. The metal of the metal-containing agent is selected from the group consisting of titanium, zirconium, and manganese and the agent is essentially devoid of sulfur and phosphorus atoms.

A further embodiment of the disclosure provides a method of lubricating moving parts with a lubricating oil exhibiting increased antioxidant properties in the substantial absence of phenolic antioxidants. The method includes using as the lubricating oil for one or more moving parts a lubricant composition including a base oil, an organomolybdenum friction modifier, and an antioxidant additive. The antioxidant additive contains a hydrocarbyl carrier fluid and an amount of hydrocarbon soluble metal compound providing from about 50 to about 1000 parts per million metal in the lubricating oil. The metal of the hydrocarbon soluble metal compound is selected from the group consisting of titanium, zirconium, and manganese.

As set forth briefly above, embodiments of the disclosure provide a hydrocarbon soluble metal antioxidant additive that may significantly improve the oxidative stability of a lubricant composition and may enable a decrease in the amount of phosphorus and sulfur additives required for equivalent oxidative stability. The additive may be mixed with an oleaginous fluid that is applied to a surface between moving parts. In other applications, the additive may be provided in a fully formulated lubricant composition. The additive is particularly directed to meeting the currently proposed GF-4 standards for passenger car motor oils and PC-10 standards for heavy duty diesel engine oil as well as future passenger car and diesel engine oil specifications.

The compositions and methods described herein are particularly suitable for reducing contamination of pollution control devices on motor vehicles or, in the alternative, the compositions are suitable for improving the oxidative stability of lubricant formulations. Other features and advantages of the compositions and methods described herein may be evident by reference to the following detailed description which is intended to exemplify aspects of the preferred embodiments without intending to limit the embodiments described herein.

It is to be understood that both the foregoing general description and the following detailed description are exemplary and explanatory only and are intended to provide further explanation of the embodiments disclosed and claimed.

DETAILED DESCRIPTION OF EMBODIMENTS

In one embodiment is presented a novel composition useful as a component in lubricating oil compositions. The composition comprises a hydrocarbon soluble metal compound that may be used in addition to or as a partial or total replacement for conventional antioxidant additives containing phosphorus and sulfur.

The primary component of the additives and concentrates provided for lubricant compositions is a hydrocarbon soluble metal compound. The term "hydrocarbon soluble" means that the compound is substantially suspended or dissolved in a hydrocarbon material, as by reaction or complexation of a reactive metal compound with a hydrocarbon material. As used herein, "hydrocarbon" means any of a vast number of compounds containing carbon, hydrogen, and/or oxygen in various combinations.

The term "hydrocarbyl" refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Examples of suitable metal compounds for use according to the disclosure, include, but are not limited to, titanium, zirconium, and manganese compounds derived from organic acids, amines, oxygenates, phenates, and sulfonates, such as titanium, zirconium, and manganese carboxylates, titanium, zirconium, and manganese phenates, titanium, zirconium, and manganese alkoxides, titanium, zirconium, and manganese aminic compounds, titanium, zirconium, and manganese sulfonates, titanium, zirconium, and manganese salicylates, titanium, zirconium, and manganese di-ketones, titanium, zirconium, and manganese crown ethers, and the like. Other than the sulfonates, such compounds may contain phosphorus and sulfur or may be substantially devoid of phosphorous and sulfur. The compounds may contain from about 3 to about 200 or more carbon atoms in a hydrocarbyl component of the compound.

Examples of metal oxygenates include, but are not limited to, $C_1$-$C_{20}$ alkyl titanates, alkyl zirconates, and alkyl manganates, such as the metal complexes, esters or reaction products of ethylene glycol, propylene glycol, octylene glycol, butanol, polybutanol, isopropanol, nonyl alcohol, 2-ethylhexanol, and iso-octyl alcohol. Aryl and aralkyl esters of titanium, zirconium, and manganese may also be used such as tetraphenyl esters, tetrabenzyl esters, diethyl diphenyl esters, and the like of titanium, zirconium, and manganese. Titanium, manganese, and zirconium di-ketones and crown ethers may also be used. Examples of suitable titanates may be found in U.S. Pat. Nos. 2,160,273; 2,960,469; and 6,074,444.

Titanium, zirconium, and manganese complex or reaction products of carboxylic acids may also be used. Such compounds may be made by reacting an alkali metal salt hydrate or aqueous solution of an organic acid, the amine salt hydrate or aqueous solution of the organic acid, and/or the ammonium salt hydrate or aqueous solution of the organic acid with the aqueous solution of metal halide and subsequently oxidizing the reaction product.

In another embodiment, a metal alkoxide such as titanium isopropoxide, titanium 2-ethylhexoxide, titanium ethoxide, or zirconium propoxide may be reacted with an organic acid to form a metal organic acid reaction product. Examples of metal/carboxylic acid products include, but are not limited to, titanium, zirconium, and manganese products of formic, acetic, proprionic, butyric, valeric, caproic, caprylic, lauric, myristic, palmitic, stearic, oleic, linoleic, linolenic, cyclohexanecarboxylic, phenylacetic, benzoic, neodecanoic acids, and the like.

Other titanium, zirconium, and manganese organic compounds that may be used include, but are not limited to metal phenates, metal salicylates, metal phosphates, metal sulfonates, and sulphurized metal phenates, wherein each aromatic group has one or more aliphatic groups to impart hydrocarbon solubility. For example, in the metal sulfonates, each sulphonic acid moiety is attached to an aromatic nucleus which in turn usually contains one or more aliphatic substituents.

The metal salt of an alkylphenol or sulfurized alkylphenol is referred to as a neutral salt or soap. The metal used to neutralize the alkylphenol or sulfurized alkylphenol can be titanium, manganese, zirconium or any of the other commonly used metals such as calcium, sodium, magnesium and barium oxides and hydroxides etc. Accordingly, the sulfonates, salicylates, phosphates, and phenates described above may include sodium, potassium, calcium, and/or magnesium sulfonates, salicylates, phosphates, and phenates in combination with the titanium, zirconium, or manganese sulfonates, salicylates, phosphates, and phenates. The highly basic salts of phenols or sulphurized phenols are often referred to as "overbased" phenates or "overbased sulphurised" phenates. For example, titanium, zirconium or manganese, may be incorporated in a detergent additive as a carbonate salt arising from overbasing the detergent.

Other hydrocarbon soluble metal compounds may include dispersants, detergents, viscosity index improvers, antiwear additives, and other antioxidant compounds that are reacted to contain a metal selected from titanium, zirconium, and/or manganese. For example, an ethylene copolymer or polyisobutylene based succinimide, Mannich or oil soluble dispersant additive, as described below, may be reacted with a metal alkoxide or any other suitable metal containing reagent to provide a metal containing dispersant.

The hydrocarbon soluble metal compounds of the embodiments described herein are advantageously incorporated into lubricating compositions. Accordingly, the hydrocarbon soluble metal compounds may be added directly to the lubricating oil composition. In one embodiment, however, hydrocarbon soluble metal compounds are diluted with a substantially inert, normally liquid organic diluent such as mineral oil, synthetic oil (e.g., ester of dicarboxylic acid), naptha, alkylated (e.g., $C_{10}$-$C_{13}$ alkyl) benzene, toluene or xylene to form a metal additive concentrate. The metal additive concentrates usually contain from about 0% to about 99% by weight diluent oil.

In the preparation of lubricating oil formulations it is common practice to introduce the metal additive concentrates in the form of 1 to 99 wt. % active ingredient concentrates in hydrocarbon oil, e.g. mineral lubricating oil, or other suitable solvent. Usually these concentrates may be added to a lubricating oil with a dispersant/inhibitor (DI) additive package and viscosity index (VI) improvers containing 0.01 to 50 parts by weight of lubricating oil per part by weight of the DI package to form finished lubricants, e.g. crankcase motor oils. Suitable DI packages are described for example in U.S. Pat. Nos. 5,204,012 and 6,034,040 for example. Among the types of additives included in the DI additive package are detergents, dispersants, antiwear agents, friction modifiers, seal swell agents, antioxidants, foam inhibitors, lubricity agents, rust inhibitors, corrosion inhibitors, demulsifiers, viscosity index improvers, and the like. Several of these components are well known to those skilled in the art and are preferably used in conventional amounts with the additives and compositions described herein.

In another embodiment, the metal additive concentrates may be top treated into a fully formulated motor oil or finished lubricant. The purpose of metal additive concentrates and DI package, of course, is to make the handling of the various materials less difficult and awkward as well as to facilitate solution or dispersion in the final blend. A representative DI package may contain, dispersants, antioxidants, detergents, antiwear agents, antifoam agents, pour point depressants, and optionally VI improvers and seal swell agents.

Embodiments described herein provide lubricating oils and lubricant formulations in which the concentration of the hydrocarbon soluble metal compound is relatively low, providing from about 1 to about 1500 parts per million (ppm) metal in terms of elemental titanium, zirconium, or manganese in the finished lubricant composition. In one embodiment, the metal compound is present in the lubricating oil compositions in an amount sufficient to provide from about 1 to about 1000 ppm metal, and in a further embodiment from about 1 to about 500 ppm metal.

Lubricant compositions made with the hydrocarbon soluble titanium, zirconium, and manganese additives described above are used in a wide variety of applications. For compression ignition engines and spark ignition engines, it is preferred that the lubricant compositions meet or exceed published GF-4 or API-CI-4 standards. Lubricant compositions according to the foregoing GF-4 or API-CI-4 standards include a base oil, the DI additive package, and/or a VI improver to provide a fully formulated lubricant. The base oil for lubricants according to the disclosure is an oil of lubricating viscosity selected from natural lubricating oils, synthetic lubricating oils and mixtures thereof. Such base oils include those conventionally employed as crankcase lubricating oils for spark-ignited and compression-ignited internal combustion engines, such as automobile and truck engines, marine and railroad diesel engines, and the like.

Dispersant Components

Dispersants contained in the DI package include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succcinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

Oxidation Inhibitor Components

Oxidation inhibitors or antioxidants reduce the tendency of base stocks to deteriorate in service which deterioration can be evidenced by the products of oxidation such as sludge and varnish-like deposits that deposit on metal surfaces and by viscosity growth of the finished lubricant. Such oxidation inhibitors include hindered phenols, sulfurized hindered phenols, alkaline earth metal salts of alkylphenolthioesters having $C_5$ to $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890.

Other antioxidants that may be used in combination with the hydrocarbon soluble titanium, zirconium, and/or manganese compounds, include sterically hindered phenols and diarylamines, alkylated phenothiazines, sulfurized compounds, and ashless dialkyldithiocarbamates. Non-limiting examples of sterically hindered phenols include, but are not limited to, 2,6-di-tertiary butylphenol, 2,6 di-tertiary butyl methylphenol, 4-ethyl-2,6-di-tertiary butylphenol, 4-propyl-2,6-di-tertiary butylphenol, 4-butyl-2,6-di-tertiary butylphenol, 4-pentyl-2,6-di-tertiary butylphenol, 4-hexyl-2,6-di-tertiary butylphenol, 4-heptyl-2,6-di-tertiary butylphenol, 4-(2-ethylhexyl)-2,6-di-tertiary butylphenol, 4-octyl-2,6-di-tertiary butylphenol, 4-nonyl-2,6-di-tertiary butylphenol, 4-decyl-2,6-di-tertiary butylphenol, 4-undecyl-2,6-di-tertiary butylphenol, 4-dodecyl-2,6-di-tertiary butylphenol, methylene bridged sterically hindered phenols including but not limited to 4,4-methylenebis(6-tert-butyl-o-cresol), 4,4-methylenebis(2-tert-amyl-o-cresol), 2,2-methylenebis(4-methyl-6 tert-butylphenol, 4,4-methylene-bis(2,6-di-tert-butylphenol) and mixtures thereof as described in U.S Publication No. 2004/0266630.

Diarylamine antioxidants include, but are not limited to diarylamines having the formula:

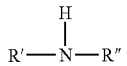

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus the diarylamine may contain at least two nitrogen atoms wherein at least one nitrogen atom has two aryl groups attached thereto, e.g. as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenylamine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyldiphenylamine; p-oriented styrenated diphenylamine; mixed butyloctyldiphenylamine; and mixed octylstyryldiphenylamine.

Examples of commercially available diarylamines include, for example, diarylamines available under the trade name IRGANOX from Ciba Specialty Chemicals; NAUGALUBE from Crompton Corporation; GOODRITE from BF Goodrich Specialty Chemicals; VANLUBE from R. T. Vanderbilt Company Inc.

Another class of aminic antioxidants includes phenothiazine or alkylated phenothiazine having the chemical formula:

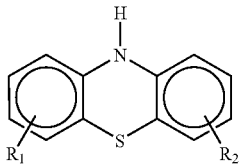

wherein $R_1$ is a linear or branched $C_1$ to $C_{24}$ alkyl, aryl, heteroalkyl or alkylaryl group and $R_2$ is hydrogen or a linear or branched $C_1$-$C_{24}$ alkyl, heteroalkyl, or alkylaryl group. Alkylated phenothiazine may be selected from the group consisting of monotetradecylphenothiazine, ditetradecylphenothiazine, monodecylphenothiazine, didecylphenothiazine, monononylphenothiazine, dinonylphenothiazine, monoctylphenothiazine, dioctylphenothiazine, monobutylphenothiazine, dibutylphenothiazine, monostyrylphenothiazine, distyrylphenothiazine, butyloctylphenothiazine, and styryloctylphenothiazine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or confonnational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Examples of commercially available sulfurized olefins which may be used include sulfurized olefins available under the trade names HiTEC® 7084 which contains approximately 20 weight % sulfur content, HiTEC® 7188 which contains approximately 12 weight % sulfur content, HiTEC® 312 which contains approximately 47.5 weight % sulfur content, all from Afton Chemical Corporation, and under the trade name ADDITIN RC 2540-A which contains approximately 38 weight % sulfur content, from Rhein Chemie Corporation.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soyabean oil, sunflower seed oil, tallow, and combinations of these.

Examples of sulfurized fatty oils which may be used include those available under the trade names ADDITIN R 4410 which contains approximately 9.5 weight % sulfur content, ADDITIN R 4412-F which contains approximately 12.5 weight % sulfur content, ADDITIN R 4417 which contains approximately 17.5 weight % sulfur content, ADDITIN RC 2515 which contains approximately 15 weight % sulfur content, ADDITIN RC 2526 which contains approximately 26 weight % sulfur content, ADDITIN RC 2810-A which contains approximately 10 weight % sulfur content, ADDITIN RC 2814-A which contains approximately 14 weight % sulfur content, and ADDITIN RC 2818-A which contains approximately 16 weight % sulfur content, all from Rhein Chemie Corporation. It is preferred that the sulfurized olefin and/or sulfurized fatty oil be a liquid of low corrosivity and low active sulfur content as determined by ASTM D 1662.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing 20 weight % sulfur, when added to the finished lubricant at a 1.0 weight % treat level, will deliver 2000 ppm of sulfur to the finished lubricant. A sulfurized fatty oil or olefin containing 10 weight % sulfur, when added to the finished lubricant at a 1.0 weight % treat level, will deliver 1000 ppm sulfur to the finished lubricant. It is preferred to add the sulfurized olefin or sulfurized fatty oil to deliver between 200 ppm and 2000 ppm sulfur to the finished lubricant. The foregoing aminic, phenothiazine, and sulfur containing antioxidants are described for example in U.S. Pat. No. 6,599,865.

The ashless dialkyldithiocarbamates which may be used as antioxidant additives include compounds that are soluble or dispersable in the additive package. It is also preferred that the ashless dialkyldithiocarbamate be of low volatility, preferably having a molecular weight greater than 250 daltons, most preferably having a molecular weight greater than 400 daltons. Examples of ashless dithiocarbamates that may be used include, but are not limited to, methylenebis(dialkyldithiocarbamate), ethylenebis(dialkyldithiocarbamate), isobutyl disulfide-2,2'-bis(dialkyldithiocarbamate), hydroxyalkyl substituted dialkyldithiocarbamates, dithiocarbamates prepared from unsaturated compounds, dithiocarbamates prepared from norbornylene, and dithiocarbamates prepared from epoxides, where the alkyl groups of the dialkyldithiocarbamate can preferably have from 1 to 16 carbons. Examples of dialkyldithiocarbamates that may be used are disclosed in the following patents: U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

Examples of preferred ashless dithiocarbamates are: Methylenebis(dibutyldithiocarbamate), Ethylenebis(dibutyldithiocarbamate), Isobutyl disulfide-2,2'-bis(dibutyldithiocarbamate), Dibutyl-N,N-dibutyl-(dithiocarbamyl) succinate, 2-hydroxypropyl dibutyldithiocarbamate, Butyl (dibutyldithiocarbamyl)acetate, and S-carbomethoxy-ethyl-N,N-dibutyl dithiocarbamate. The most preferred ashless dithiocarbamate is methylenebis(dibutyldithiocarbamate).

Zinc dialkyl dithiophosphates ("Zn DDPs") are also used in lubricating oils. Zn DDPs have good antiwear and antioxidant properties and have been used to pass cam wear tests, such as the Seq. IVA and TU3 Wear Test. Many patents address the manufacture and use of Zn DDPs including U.S. Pat. Nos. 4,904,401; 4,957,649; and 6,114,288. Non-limiting general Zn DDP types are primary, secondary and mixtures of primary and secondary Zn DDPs Likewise, organomolybdenum containing compounds used as friction modifiers may also exhibit antioxidant functionality. U.S. Pat. No. 6,797,677 describes a combination of organomolybdenum compound, alkylphenothizine and alkyldiphenylamines for use in finished lubricant formulations. Examples of suitable molybdenum containing friction modifiers are described below under friction modifiers.

The hydrocarbon soluble metal compounds described herein may be used with any or all of the foregoing antioxidants in any and all combinations and ratios. It is understood that various combinations of phenolic, aminic, sulfur containing and molybdenum containing additives may be optimized for the finished lubricant formulation based on bench or engine tests or modifications of the dispersant, VI improver, base oil, or any other additive.

In one embodiment, additive concentrates and lubricating oil formulations described herein are essentially devoid of soluble copper compounds. In another embodiment, additive concentrates and lubricating oil formulations described herein are essentially devoid of phenolic antioxidant compounds.

Friction Modifier Components

A sulfur- and phosphorus-free organomolybdenum compound that may be used as a friction modifier may be prepared by reacting a sulfur- and phosphorus-free molybdenum source with an organic compound containing amino and/or alcohol groups. Examples of sulfur- and phosphorus-free molybdenum sources include molybdenum trioxide, ammonium molybdate, sodium molybdate and potassium molybdate. The amino groups may be monoamines, diamines, or polyamines. The alcohol groups may be mono-substituted alcohols, diols or bis-alcohols, or polyalcohols. As an example, the reaction of diamines with fatty oils produces a product containing both amino and alcohol groups that can react with the sulfur- and phosphorus-free molybdenum source.

Examples of sulfur- and phosphorus-free organomolybdenum compounds include the following:

1. Compounds prepared by reacting certain basic nitrogen compounds with a molybdenum source as described in U.S. Pat. Nos. 4,259,195 and 4,261,843.

2. Compounds prepared by reacting a hydrocarbyl substituted hydroxy alkylated amine with a molybdenum source as described in U.S. Pat. No. 4,164,473.

3. Compounds prepared by reacting a phenol aldehyde condensation product, a mono-alkylated alkylene diamine, and a molybdenum source as described in U.S. Pat. No. 4,266,945.

4. Compounds prepared by reacting a fatty oil, diethanolamine, and a molybdenum source as described in U.S. Pat. No. 4,889,647.

5. Compounds prepared by reacting a fatty oil or acid with 2-(2-aminoethyl)aminoethanol, and a molybdenum source as described in U.S. Pat. No. 5,137,647.

6. Compounds prepared by reacting a secondary amine with a molybdenum source as described in U.S. Pat. No. 4,692,256.

7. Compounds prepared by reacting a diol, diamino, or amino-alcohol compound with a molybdenum source as described in U.S. Pat. No. 5,412,130.

8. Compounds prepared by reacting a fatty oil, monoalkylated alkylene diamine, and a molybdenum source as described in U.S. Pat. No. 6,509,303.

9. Compounds prepared by reacting a fatty acid, monoalkylated alkylene diamine, glycerides, and a molybdenum source as described in U.S. Pat. No. 6,528,463.

Examples of commercially available sulfur- and phosphorus-free oil soluble molybdenum compounds are available under the trade name SAKURA-LUBE from Asahi Denka Kogyo K.K., and MOLYVAN® from R. T. Vanderbilt Company, Inc.

Molybdenum compounds prepared by reacting a fatty oil, diethanolamine, and a molybdenum source as described in U.S. Pat. No. 4,889,647 are sometimes illustrated with the following structure, where R is a fatty alkyl chain, although the exact chemical composition of these materials is not fully known and may in fact be multi-component mixtures of several organomolybdenum compounds.

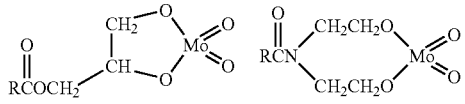

Sulfur-containing organomolybdenum compounds may be used and may be prepared by a variety of methods. One method involves reacting a sulfur and phosphorus-free molybdenum source with an amino group and one or more sulfur sources. Sulfur sources can include for example, but are not limited to, carbon disulfide, hydrogen sulfide, sodium sulfide and elemental sulfur. Alternatively, the sulfur-containing molybdenum compound may be prepared by reacting a sulfur-containing molybdenum source with an amino group or thiuram group and optionally a second sulfur source. Examples of sulfur- and phosphorus-free molybdenum sources include molybdenum trioxide, ammonium molybdate, sodium molybdate, potassium molybdate, and molybdenum halides. The amino groups may be monoamines, diamines, or polyamines. As an example, the reaction of molybdenum trioxide with a secondary amine and carbon disulfide produces molybdenum dithiocarbamates. Alternatively, the reaction of $(NH_4)_2Mo_3S_{13}*n(H_2O)$ where n varies between 0 and 2, with a tetralkylthiuram disulfide, produces a trinuclear sulfur-containing molybdenum dithiocarbamate.

Examples of sulfur-containing organomolybdenum compounds appearing in patents and patent applications include the following:

1. Compounds prepared by reacting molybdenum trioxide with a secondary amine and carbon disulfide as described in U.S. Pat. Nos. 3,509,051 and 3,356,702.

2. Compounds prepared by reacting a sulfur-free molybdenum source with a secondary amine, carbon disulfide, and an additional sulfur source as described in U.S. Pat. No. 4,098,705.

3. Compounds prepared by reacting a molybdenum halide with a secondary amine and carbon disulfide as described in U.S. Pat. No. 4,178,258.

4. Compounds prepared by reacting a molybdenum source with a basic nitrogen compound and a sulfur source as described in U.S. Pat. Nos. 4,263,152, 4,265,773, 4,272,387, 4,285,822, 4,369,119, and 4,395,343.

5. Compounds prepared by reacting ammonium tetrathiomolybdate with a basic nitrogen compound as described in U.S. Pat. No. 4,283,295.

6. Compounds prepared by reacting an olefin, sulfur, an amine and a molybdenum source as described in U.S. Pat. No. 4,362,633.

7. Compounds prepared by reacting ammonium tetrathiomolybdate with a basic nitrogen compound and an organic sulfur source as described in U.S. Pat. No. 4,402,840.

8. Compounds prepared by reacting a phenolic compound, an amine and a molybdenum source with a sulfur source as described in U.S. Pat. No. 4,466,901.

9. Compounds prepared by reacting a triglyceride, a basic nitrogen compound, a molybdenum source, and a sulfur source as described in U.S. Pat. No. 4,765,918.

10. Compounds prepared by reacting alkali metal alkylthioxanthate salts with molybdenum halides as described in U.S. Pat. No. 4,966,719.

11. Compounds prepared by reacting a tetralkylthiuram disulfide with molybdenum hexacarbonyl as described in U.S. Pat. No. 4,978,464.

12. Compounds prepared by reacting an alkyl dixanthogen with molybdenum hexacarbonyl as described in U.S. Pat. No. 4,990,271.

13. Compounds prepared by reacting alkali metal alkylxanthate salts with dimolybdenum tetra-acetate as described in U.S. Pat. No. 4,995,996.

14. Compounds prepared by reacting $(NH_4)_2Mo_3S_{13}*2H_2O$ with an alkali metal dialkyldithiocarbamate or tetralkyl thiuram disulfide as described in U.S. Pat. No. 6,232,276.

15. Compounds prepared by reacting an ester or acid with a diamine, a molybdenum source and carbon disulfide as described in U.S. Pat. No. 6,103,674.

16. Compounds prepared by reacting an alkali metal dialkyldithiocarbamate with 3-chloropropionic acid, followed by molybdenum trioxide, as described in U.S. Pat. No. 6,117,826.

Examples of commercially available sulfur-containing oil soluble molybdenum compounds available under the trade name SAKURA-LUBE, from Asahi Denka Kogyo K.K., MOLYVAN® from R. T. Vanderbilt Company, and NAUGALUBE from Crompton Corporation.

Molybdenum dithiocarbamates may be illustrated by the following structure,

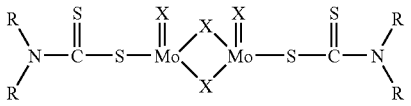

where R is an alkyl group containing 4 to 18 carbons or H, and X is O or S.

Glycerides may also be used alone or in combination with other friction modifiers. Suitable glycerides include glycerides of the formula:

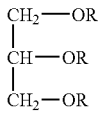

wherein each R is independently selected from the group consisting of H and C(O)R' where R' may be a saturated or an unsaturated alkyl group having from 3 to 23 carbon atoms. Examples of glycerides that may be used include glycerol monolaurate, glycerol monomyristate, glycerol monopalmitate, glycerol monostearate, and monoglycerides derived from coconut acid, tallow acid, oleic acid, linoleic acid, and linolenic acids. Typical commercial monoglycerides contain substantial amounts of the corresponding diglycerides and triglycerides. These materials are not detrimental to the production of the molybdenum compounds, and may in fact be more active. Any ratio of mono- to di-glyceride may be used, however, it is preferred that from 30 to 70% of the available sites contain free hydroxyl groups (i.e., 30 to 70% of the total R groups of the glycerides represented by the above formula are hydrogen). A preferred glyceride is glycerol monooleate, which is generally a mixture of mono, di, and tri-glycerides derived from oleic acid, and glycerol. Suitable commercially-available glycerides include glycerol monooleates available from Afton Chemical Corporation of Richmond, Va. under the trade name HiTEC® 7133 which generally contains approximately 50% to 60% free hydroxyl groups.

Rust inhibitors selected from the group consisting of nonionic polyoxyalkylene polyols and esters thereof, polyoxyalkylene phenols, and anionic alkyl sulfonic acids may be used.

A small amount of a demulsifying component may be used. A preferred demulsifying component is described in EP 330,522. Such demulsifying component may be obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

Seal swell agents, as described, for example, in U.S. Pat. Nos. 3,794,081 and 4,029,587, may also be used.

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Functionalized olefin copolymers that may be used include interpolymers of ethylene and propylene which are grafted with an active monomer such as maleic anhydride and then derivatized with an alcohol or amine. Other such copolymers are copolymers of ethylene and propylene which are grafted with nitrogen compounds.

Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 10% by weight based on the weight of the lubricating oil composition.

The hydrocarbon soluble metal additives may be added directly to the lubricating oil composition. In one embodiment, however, they are diluted with a substantially inert, normally liquid organic diluent such as mineral oil, synthetic oil, naphtha, alkylated (e.g. $C_{10}$ to $C_{13}$ alkyl) benzene, toluene or xylene to form an additive concentrate. These concentrates usually contain from about 1% to about 100% by weight and in one embodiment about 10% to about 90% by weight of the titanium compound.

Base Oils

Base oils suitable for use in formulating the compositions, additives and concentrates described herein may be selected from any of the synthetic or natural oils or mixtures thereof. The synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like.

Natural base oils include animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. The base oil typically has a viscosity of about 2.5 to about 15 cSt and preferably about 2.5 to about 11 cSt at 100° C.

The following examples are given for the purpose of exemplifying aspects of the embodiments and are not intended to limit the embodiments in any way.

EXAMPLE 1

Titanium Neodecanoate

Neodecanoic acid (600 grams) was placed into a reaction vessel equipped with a condenser, Dean-stark trap, thermometer, thermocouple, and a gas inlet. Nitrogen gas was bubbled into the acid. Titanium isopropoxide (245 grams) was slowly added to the reaction vessel with vigorous stirring. The reactants were heated to 140° C. and stirred for one hour. Overheads and condensate from the reaction were collected in the trap. A subatmospheric pressure was applied to the reaction vessel and the reactants were stirred for an additional two hours until the reaction was complete. Analysis of the product indicated that the product had a kinematic viscosity of 14.3 cSt at 100° C. and a titanium content of 6.4 percent by weight.

EXAMPLE 2

Titanated Glycerol Mono-Oleate

A pre-warmed and homogeneous glycerol mono-oleate (250 grams) was placed into a reaction vessel equipped with a condenser, Dean-stark trap, thermometer, thermocouple, and a gas inlet. Nitrogen gas was bubbled into the reactant as the reactant was heated to 30° C. Titanium isopropoxide (10 grams) was slowly added to the reaction vessel with vigorous stirring when the reactant obtained the desired 30° C. temperature and the reactants were stirred at this temperature for 15 minutes. The reactants were then heated to 50° C. and stirred for two hours. Overheads and condensate from the reaction were collected in the trap. When the reaction was complete, the product was stripped of unreacted components. Analysis of the product indicated that the product had a kinematic viscosity of 10.1 cSt at 100° C. and a titanium content of 0.65 percent by weight.

EXAMPLE 3

Titanated Aminic Compound

An uncapped 2100 molecular weight polyisobutenyl bis-succinimide (400 grams) having a target nitrogen content of 1.03 wt. % was placed into a reaction vessel equipped with a condenser, Dean-stark trap, thermometer, thermocouple, and a gas inlet. Nitrogen gas was bubbled into the reactant. Titanium isopropoxide (5.32 grams) was slowly added to the reaction vessel with vigorous stirring. The reactants were heated to 140° C. and stirred for one hour. Overheads and condensate from the reaction were collected in the trap. A subatmospheric pressure was applied to the reaction vessel and the reactants were stirred for an additional two hours until the reaction was complete. Analysis of the product indicated that the product had a kinematic viscosity of 307 cSt at 100° C., a titanium content of 0.22 percent by weight, and a nitrogen content of 1.02 percent by weight.

EXAMPLE 4

Manganese Neodecanoate

Neodecanoic acid (300 grams) and manganese (II) acetate (106 grams) were both placed into a reaction vessel equipped with a condenser, Dean-stark trap, thermometer, thermocouple, and a gas inlet. Nitrogen gas was bubbled into the reactants. The reactants were heated to 140° C. and stirred for two hours. Overheads and condensate from the reaction were collected in the trap. A subatmospheric pressure was applied to the reaction vessel and the reactants were stirred for an additional two hours at 140° C. until the reaction was complete. Analysis of the product indicated that the product had a kinematic viscosity of 54.8 cSt at 100° C. and a manganese content of 8.1 percent by weight.

EXAMPLE 5

Zirconium Neodecanoate

Neodecanoic acid (300 grams) was placed into a reaction vessel equipped with a condenser, Dean-stark trap, thermometer, thermocouple, and a gas inlet. Nitrogen gas was bubbled into the reactants. With vigorous stirring slowly add the zirconium propoxide (202 grams). The reactants were heated to 140° C. and stirred for one hour. Overheads and condensate from the reaction were collected in the trap. A subatmospheric pressure was applied to the reaction vessel and the reactants were stirred for an additional two hours at 140° C. or until the reaction was complete. Analysis of the product indicated that the product had a kinematic viscosity of 198 cSt at 100° C. and a zirconium content of 14.2 percent by weight.

EXAMPLE 6

Titanium Bis-beta-Diketonate 2,4 Pentanedione (226 grams) was placed into a reaction vessel equipped with a condenser, Dean-stark trap, thermometer, thermocouple, and a gas inlet. Nitrogen gas was bubbled into the reactants. Titanium isopropoxide (245.4 grams) was added slowly to the reaction flask with vigorous stirring. The reaction mass was heated to 120° C. and stirred for two hours. Overheads and condensate from the reaction were collected in the trap. A subatmospheric pressure was applied to the reaction vessel and the reactants were stirred for an additional two hours at 120° C. or until the reaction was complete. Analysis of the product indicated that the product had a kinematic viscosity of 4.64 cSt at 100° C. and a titanium content of 12.68 percent by weight.

EXAMPLE 7

Antioxidant Effects of Hydrocarbon Soluble Titanium Additives

In the following examples, hydrocarbon soluble titanium compounds were added as a top treat to a preblend lubricant composition to provide titanium metal in amounts ranging from about 50 to about 830 ppm in the finished lubricant. The preblend used was a prototype passenger car engine oil formulated in Group III basestock detergents, dispersants, pour point depressants, friction modifiers, antioxidants, and viscosity index improvers and was devoid of titanium metal as shown in the following table.

TABLE 1

5W30 Base Lubricant Composition

| Base Lubricant Composition Components | (wt. %) |
|---|---|
| Group II, 110 N, Base Oil | 5.00 |
| Group II, 225 N, Base Oil | 5.00 |
| Group III base oil | 72.65 |
| 150 N base oil | 0.46 |
| HiTEC ®-672, pour point depressant | 0.10 |
| 2100 MW bis-succinimide dispersant | 1.50 |
| 1300 MW bis-succinimide dispersant | 4.30 |
| Glycerol monooleate friction modifier | 0.30 |
| sulfurized alpha-olefin antioxidant | 0.80 |
| Aromatic aminic antioxidant | 0.80 |
| molybdenum containing friction modifier | 0.05 |
| antifoam agent | 0.01 |
| 300 TBN overbased sulfonate | 1.80 |
| mixed primary and secondary ZDDP | 0.93 |
| Olefin copolymer, viscosity index improver | 6.30 |
| Total | 100.00 |

The oxidation stability of oils formulated with from about 0 to about 800 parts per million in terms of elemental titanium were evaluated using a TEOST MHT-4 test. The TEOST MHT-4 test is a standard lubricant industry test for the evaluation of the oxidation and carbonaceous deposit-forming characteristics of engine oils. The test is designed to simulate high temperature deposit formation in the piston ring belt area of modern engines. The test uses a patented instrument (U.S. Pat. No. 5,401,661 and U.S. Pat. No. 5,287,731; the substance of each patent is hereby incorporated by reference) with the MHT-4 protocol being a relatively new modification to the test. Details of the test operation and specific MHT-4 conditions have been published by Selby and Florkowski in a paper entitled, "The Development of the TEOST Protocol MHT as a Bench Test of Engine Oil Piston Deposit Tendency" presented at the 12$^{th}$ International Colloquium Technische Akademie Esslingen, Jan. 11-13, 2000, Wilfried J. Bartz editor. In general, the lower the milligrams of deposit, the better the additive.

TABLE 2

TEOST Test Results for the Oil of Table 1 Top Treated with Titanium Neodecanoate

| Sample No. | Oil in blend (wt. %) | Ti-neodecanoate (wt. %) | Ti metal (ppm) | TEOST (milligrams) |
|---|---|---|---|---|
| 1 | 100 | 0 | 0 | 39.4 |
| 2 | 99.92 | 0.08 | 51 | 29.9 |
| 3 | 99.84 | 0.16 | 101 | 22.3 |
| 4 | 99.68 | 0.32 | 208 | 22.8 |
| 5 | 99.36 | 0.64 | 410 | 33.0/29.6 |
| 6 | 99.04 | 0.96 | 621 | 21.2 |
| 7 | 98.72 | 1.28 | 822 | 27.9 |

In the foregoing table 2, the oxidation stability of samples 2-7 containing the indicated amounts of titanium neodecanoate were compared with the oxidation stability of the base oil (sample 1) used in samples 2-7. As indicated by the data, there is a dramatic increase in oxidation stability for oils containing from about 50 to about 800 ppm titanium metal as compared to the oxidation stability of the base oil (Sample 1) having a TEOST result of 39.4.

TABLE 3

TEOST Test Results For Oil of Table 1 Top Treated With Various Titanium, Zirconium and Manganese Additives

| Sample No. | Oil in blend (wt. %) | Metal compound wt. %) | metal (ppm) | TEOST (milligrams) |
|---|---|---|---|---|
| 8 | 100 | 0 | 0 | 39.4 |
| 9 | 99.80 | 0.20 | 99 | 31.7 |
| 10 | 99.84 | 0.16 | 99 | 20.7 |
| 11 | 99.78 | 0.22 | 102 | 32.3 |
| 12 | 99.51 | 0.49 | 179 | 26.4 |
| 13 | 99.93 | 0.07 | 84.5 | 23.3 |
| 14 | 99.88 | 0.12 | 97.0 | 18.4 |

In the foregoing table 3, the oxidation stability of base oils containing other hydrocarbon soluble metal compounds (samples 9-14) were compared to the oxidation stability of the base oil (Sample 8) used to prepare the samples 9-14. The base oil of samples 8-14 was similar to the base oil used in samples 1-7 above. Each of the samples 9-12 were formulated to provide about 100 ppm titanium in the base oil formulation.

Sample 9 contained titanium IV 2-propanolato, tris isooctadecanoato-O as the hydrocarbon soluble metal compound having about 4.97 wt. % titanium metal in the compound. Sample 10 contained titanium IV 2,2(bis 2-propenolatomethyl)butanolato, tris neodecanoato-O as the hydrocarbon soluble metal compound having about 6.09 wt. % titanium metal in the compound. Sample 11 contained titanium IV 2-propanolato, tris(dioctyl)phosphato-O as the hydrocarbon metal compound having about 4.57 wt. % titanium metal in the compound. Sample 12 contained titanium IV 2-propanolato, tris(do-decyl)benzenesulfanato-O as the hydrocarbon soluble metal compound having about 3.47 wt. % titanium metal in the compound. Each of the titanium compounds in samples 9-12 is available from Kenrich Petrochemicals, Inc. of Bayonne, N.J. As shown by Samples 9-12, each of the titanium compounds significantly increased the oxidation stability of the base oil (Sample 8).

Sample 13 contained zirconium neodecanoate as the hydrocarbon soluble metal compound having about 12 wt. % zirconium in the compound. Sample 14 contained manganese neodecanoate as the hydrocarbon soluble metal compound having about 8.0 wt. % manganese in the compound. As shown by Samples 13 and 14, the zirconium and manganese compounds were also effective in increasing the oxidation stability of the base oil.

As illustrated by the foregoing results, samples 2-14 containing from about 50 to about 800 ppm metal in the form of a hydrocarbon soluble metal compound significantly outperformed a conventional lubricant composition containing no hydrocarbon soluble metal compound. Sample 1 containing no hydrocarbon soluble metal compound had a TEOST result of 39.4 milligrams whereas the other samples (2-14) containing titanium, zirconium, or manganese had TEOST results ranging from about 18 to about 32 milligrams.

It is expected that formulations containing from about 50 to about 800 ppm or more titanium, zirconium, or manganese metal in the form of a hydrocarbon soluble metal compound will enable a reduction in conventional phosphorus and sulfur antiwear agents thereby improving the performance of pollution control equipment on vehicles while achieving a similar or improved antioxidant performance or benefit.

At numerous places throughout this specification, reference has been made to a number of U.S. patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A crankcase lubricant composition for an internal combustion engine containing a base oil of lubricating viscosity; an antioxidant compound and an amount of at least one hydrocarbon soluble titanium compound effective to provide an oxidation stability rating of the lubricant composition of less than about 39 milligrams according to a TEOST MHT-4 test, wherein lubricant composition is devoid of phenolic antioxidant compounds and is devoid of titanium compounds that contain phosphorus atoms and wherein the amount of hydrocarbon soluble titanium compound provides an amount of titanium ranging from about 1 to about 1500 ppm in the lubricant composition, wherein the hydrocarbon soluble titanium compound comprises the reaction product of a titanium alkoxide and a non-linear carboxylic acid.

2. The lubricant composition of claim 1, wherein the internal combustion engine comprises a spark ignition engine.

3. The lubricant composition of claim 1, wherein the internal combustion engine comprises a compression ignition engine.

4. The lubricant composition of claim 1, wherein the hydrocarbon soluble titanium compounds comprises a reaction product of titanium isopropoxide and neodecanoic acid.

5. The lubricant composition of claim 1, wherein the antioxidant compound is selected from the group consisting of alkylated phenothiazine compounds, sulfurized olefins, alkylated diphenylamine compounds, and mixtures thereof.

6. A motor vehicle comprising the lubricant composition of claim 1.

7. A vehicle having a crankcase and containing a lubricant in the crankcase for lubricating the vehicle, the lubricant comprising an oil of lubricating viscosity, an organomolybdenum friction modifier, an antioxidant compound, and an amount of at least one hydrocarbon soluble titanium compound effective to provide an oxidation stability rating of the lubricant of less than about 39 milligrams according to a TEOST MHT-4 test, wherein the lubricant is devoid of titanium compounds that contain phosphorus atoms and titanium compounds that contain sulfur and phosphorus atoms, and wherein the lubricant is substantially devoid of phenolic antioxidant compounds and wherein the amount of hydrocarbon soluble titanium compound provides from about 1 to about 1500 parts per million titanium in the lubricant, wherein the hydrocarbon soluble titanium compound comprises the reaction product of a titanium alkoxide and a non-linear carboxylic acid.

8. The vehicle of claim 7, wherein the hydrocarbon soluble titanium compound comprises a reaction product of titanium isopropoxide and neodecanoic acid.

9. The vehicle of claim 7, wherein the antioxidant compound is selected from the group consisting of alkylated phenothiazine compounds, sulfurized olefins, alkylated diphenylamine compounds, and mixtures thereof.

10. The vehicle of claim 7, wherein the vehicle includes a heavy duty diesel engine.

11. A fully formulated crankcase lubricant composition for an engine comprising a base oil component of lubricating viscosity, an antioxidant compound, and an amount of hydrocarbon soluble titanium-containing agent effective to provide an oxidation stability rating of the lubricant composition of less than about 39 milligrams according to a TEOST MHT-4 test, wherein the lubricant composition is devoid of phenolic antioxidant compounds and is devoid of titanium-containing agents that contain phosphorus atoms and wherein the amount of hydrocarbon soluble titanium-containing agent provides from about 1 to about 1500 parts per million titanium in the lubricant composition, wherein the hydrocarbon soluble titanium compound comprises the reaction product of a titanium alkoxide and a non-linear carboxylic acid.

12. The lubricant composition of claim 11 wherein the lubricant composition comprises a low ash, low sulfur, and low phosphorus lubricant composition suitable for compression ignition engines.

13. The lubricant composition of claim 11, wherein the hydrocarbon soluble titanium-containing agent is selected from the group consisting of titanium compounds derived from organic acids, amines, oxygenates, and phenates, and the agent is essentially devoid of sulfur and phosphorus atoms.

14. The lubricant composition of claim 13, wherein the hydrocarbon soluble titanium-containing agent comprises a reaction product of titanium isopropoxide and neodecanoic acid.

15. A method of reducing oxidation of engine lubricant compositions during operation of an engine containing the lubricant composition in the substantial absence of phenolic antioxidant compounds, comprising contacting a crankcase of the engine with a lubricant composition comprising a base oil of lubricating viscosity, an antioxidant compound, and an amount of a hydrocarbon soluble titanium compound effective to provide an oxidation stability rating of the lubricant composition of less than about 39 milligrams according to a TEOST MHT-4 test, wherein the lubricant composition is devoid of titanium compounds that contain phosphorus atoms and wherein the amount of hydrocarbon soluble titanium compound provides from about 1 to about 1500 parts per million titanium in the lubricant composition, wherein the hydrocarbon soluble titanium compound comprises the reaction product of a titanium alkoxide and a non-linear carboxylic acid.

16. The method of claim 15 wherein the engine comprises a heavy duty diesel engine.

17. The method of claim 15, wherein the hydrocarbon soluble titanium compound comprises a reaction product of titanium isopropoxide and neodecanoic acid.

18. The method of claim 15, wherein the lubricant composition further comprises an organomolybdenum friction modifier.

19. A method of lubricating moving parts of an engine crankcase with a lubricating oil exhibiting an oxidation stability rating of less than about 39 milligrams according to a TEOST MHT-4 test in the substantial absence of phenolic antioxidants, the method comprising using as the lubricating oil for one or more moving parts a lubricant composition containing a base oil, an organomolybdenum friction modifier, and an antioxidant additive, the antioxidant additive comprising a hydrocarbyl carrier fluid, an amount of hydrocarbon soluble titanium compound providing from about 1 to about 1500 parts per million titanium in the lubricating oil, and an antioxidant compound other than the titanium compound, wherein the lubricant composition is devoid of titanium compounds that contain phosphorus atoms, wherein the hydrocarbon soluble titanium compound comprises the reaction product of a titanium alkoxide and a non-linear carboxylic acid.

20. The method of claim 19, wherein the moving parts comprise moving parts of an internal combustion engine.

21. The method of claim 20, wherein the engine is selected from the group consisting of a compression ignition engine and a spark ignition engine.

22. The method of claim 20, wherein the lubricating oil comprises a crankcase oil present in the crankcase of the engine.

23. The method of claim 19, wherein the hydrocarbon soluble titanium compound comprises a reaction product of titanium isopropoxide and neodecanoic acid.

* * * * *

UNITED STATES PATENT AND TRADEMARK OFFICE

CERTIFICATE OF CORRECTION

PATENT NO. : 7,615,520 B2
APPLICATION NO. : 11/080007
DATED : November 10, 2009
INVENTOR(S) : Carl K. Esche, Jr.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 529 days.

Signed and Sealed this

Nineteenth Day of October, 2010

David J. Kappos

David J. Kappos
*Director of the United States Patent and Trademark Office*